US005376401A

United States Patent [19]

Conroy et al.

[11] Patent Number: 5,376,401

[45] Date of Patent: Dec. 27, 1994

[54] MINIMIZATION OF SLIDE INSTABILITIES BY VARIATIONS IN LAYER PLACEMENT, FLUID PROPERTIES AND FLOW CONDITIONS

[75] Inventors: James E. Conroy, Rochester; Steven J. Weinstein, Fairport, both of N.Y.

[73] Assignee: Eastman Kodak Company, Rochester, N.Y.

[21] Appl. No.: 75,974

[22] Filed: Jun. 11, 1993

[51] Int. Cl.[5] ..... B05D 1/30

[52] U.S. Cl. ..... 427/8; 427/420; 118/DIG. 4

[58] Field of Search ..... 427/420, 8; 118/DIG. 4

[56] References Cited

U.S. PATENT DOCUMENTS

| | | | |
|---|---|---|---|
| 2,681,294 | 6/1954 | Beguin . | |
| 4,052,373 | 10/1977 | Sera et al. | 260/117 |
| 4,460,680 | 7/1984 | Ogawa et al. | 430/434 |
| 4,476,218 | 10/1984 | Ogawa et al. | 430/539 |
| 4,481,284 | 11/1984 | Ogawa et al. | 430/355 |
| 4,533,623 | 8/1985 | Urata et al. | 430/309 |
| 4,552,835 | 11/1985 | Nakamura et al. | 430/523 |
| 4,572,849 | 2/1986 | Koepke et al. | 427/402 |
| 4,746,594 | 5/1988 | Kasama et al. | 430/264 |
| 4,840,881 | 5/1983 | Watanabe et al. | 430/512 |
| 4,847,189 | 8/1983 | Suzuki et al. | 430/567 |
| 4,942,068 | 7/1990 | Schweicher et al. | 427/420 |
| 4,977,065 | 12/1990 | Westfal et al. | 430/271 |
| 4,978,607 | 12/1990 | Roche et al. | 430/642 |
| 4,990,438 | 2/1991 | Ogi et al. | 430/622 |
| 4,990,439 | 2/1991 | Goan et al. | 430/569 |
| 5,009,990 | 4/1991 | Scheerer et al. | 430/539 |
| 5,021,336 | 6/1991 | Reuss et al. | 430/608 |

FOREIGN PATENT DOCUMENTS

| | | |
|---|---|---|
| 3721503 | 9/1988 | Germany . |
| 52-127329 | 10/1977 | Japan . |
| 60-12542 | 1/1985 | Japan . |
| 61-61146 | 3/1986 | Japan . |

OTHER PUBLICATIONS

AICHE Journal entitled, "Wave Propagation in the Flow of Shear Thinning Fluids Down an Inclined," Dec. 1990.

*Primary Examiner*—Shrive Beck
*Assistant Examiner*—Katherine A. Bareford
*Attorney, Agent, or Firm*—Carl F. Ruoff

[57] ABSTRACT

The present invention is a method determining where to add hardener in a multilayer coating pack on a web fed through a coating station. The process includes determining the frequency and amplitude of the process noise associated with the coating station, determining the growth factor as a function of frequency on the incline surface and repeating these two steps for each of the layers in the coating pack. The plurality of growth factors obtained as a function of frequency is converted into a plurality of wave amplification versus frequency. After the plurality of wave amplitudes versus frequency is determined, one then selects from this plurality the one which is below a predetermined value in order to reduce coating cross streaks.

8 Claims, 9 Drawing Sheets

FLOW →

FLOW →

MINIMIZATION OF SLIDE INSTABILITIES BY VARIATIONS IN LAYER PLACEMENT, FLUID PROPERTIES AND FLOW CONDITIONS

FIELD OF THE INVENTION

The present invention relates generally to a method of coating photographic materials onto a support. More specifically, the present invention provides a method for coating a support from a slide hopper wherein coating cross streaks and other imperfections are reduced.

BACKGROUND OF THE INVENTION

In the coating of photographic layers on a support such as film base or paper, a number of individual layers are coated onto the support simultaneously by means of a multiple slot coating hopper. This process may be performed many times, resulting in a multiplicity of multilayer coatings on the same base. It is often desirable to match the viscosity and density of each of the layers in the multiple layer pack; however, this is not always possible. When the viscosity or density of a layer becomes much different than layer adjacent to it there is a risk of hopper slide wave nonuniformity. Hopper slide waves form because of disturbances to the coating process, such as machine vibrations or flow pulsations. When the viscosity or density of two layers becomes very different these waves can grow substantially resulting in nonuniformity in the final product and significant waste.

In general, in photographic applications densities are very similar. An example of a situation which very often results in a layer viscosity mismatch in the coating of aqueous gelatin based photographic systems is the addition of a diffusible hardener in one of the layers of the last multilayer application. The hardener is designed to react with gelatin to form chemical crosslinks between gelatin molecules in all layers of the plurality of multilayer coatings. This process results in a hardened product with desirable mechanical characteristics for the photographic system. Since this hardener composition is, by design, very reactive with gelatin, the layer which is delivered with the hardener must typically be delivered and coated at a very low gelatin percentage with respect to the solvent, which is typically water, to reduce reactivity. This results in a layer of very low viscosity. It is desirable to coat all layers at as high a viscosity as possible to reduce the severity of nonuniformity due to such things as flow after coating resulting from nonplanar base and flow after coating resulting from air impingement on the coating. It is also desirable to reduce the time needed to chill set a coating so that the coating speed may be maximized. A polymer thickener may be added to increase this viscosity without increasing the hardener gelatin reaction rate. However, this viscosity increase is typically limited by a number of factors including sensitometric shift and changes in layer rheology.

Therefore, very often in practice of the art, the last multilayer application of a photographic product has a low viscosity layer, i.e. the layer which includes hardener, as one of the layers in the pack with the rest of the layers being coated at relatively high viscosities. It then falls upon the engineer to choose which of the plurality of layers is to be the low viscosity layer or layer containing hardener since the hardener can typically be added to any of the layers. An unwise choice of hardener placement may result in a number of coating nonuniformities in the final product. The most important of these nonuniformities are interfacial waves due to strain rate discontinuities at the interfaces between the low and high viscosity layers during flow down the hopper slide. Interfacial waves are formed by disturbances, the most common being hopper vibration, flow rate pulsations, or particulate disturbances.

In many situations, one or more of the layers will have a higher or lower viscosity than the remaining layers due to for example, addition of other chemical addenda. The present invention allows one to place the higher or lower viscosity layer in the position that will produce the most uniform coating. The present invention also provides a method for choosing the layer of a multilayer coating pack to which such viscosity-affecting addenda should be added.

SUMMARY OF THE INVENTION

The present invention is a method of selecting the optimum coating pack structure from a plurality of coating pack structures for reducing cross streaks on a web fed through a coating station, the coating station including a hopper having a plurality of parallel metering slots between a plurality of hopper elements which form an inclined surface, the liquid layers which flow down the surface, the superimposed layers forming a plurality of interfaces between the liquid layers. The method includes determining growth factor and amplitude ratio as a function of frequency for each of the plurality of interfaces over each slide element for each coating pack structure. The plurality of growth factor as a function of frequency is converted into a plurality of maximum wave amplifications versus frequency for each interface. This is repeated for each of the plurality of layers. The coating pack structure is then selected which minimizes the plurality of wave amplifications.

The present invention is also a method of reducing coating cross streaks on a web fed through a coating station, the coating station including a hopper having a plurality of parallel metering slots between a plurality of hopper elements which form an inclined surface, the plurality of metering slots delivering a plurality of liquid layers which flow down the inclined surface superimposed on one another, the superimposed layers forming a plurality of interfaces between the superimposed layers. The method includes determining the frequency and amplitude of process noise associated with the coating station, determining growth factor and amplitude ratio as a function of frequency of each of the interfaces over each slide element on the inclined surface for a situation wherein a diffusible hardener is added to one of the plurality of layers. This is repeated assuming a hardener addition to each of the plurality of layers. The plurality of growth factors as a function of frequency is converted to a plurality of maximum wave amplifications versus frequency for each of the plurality of interfaces. A plurality of wave amplitudes versus frequency is determined by multiplying the amplitude of the process noise for each frequency by the plurality of maximum wave amplifications. The last step is selecting from the plurality of wave amplitudes versus frequency the hardener placement which results in the minimum wave amplitude and adding hardener to the layer whose result was selected.

In an alternate embodiment of the present invention it is possible to determine whether a coating event will produce acceptable product.

For a better understanding of the present invention, together with other and further objects, advantages and capabilities thereof, reference is made to the following disclosure and appended claims in connection with the above-described drawing.

DESCRIPTION OF THE PREFERRED EMBODIMENTS

The present invention is a method of choosing the location of a low or high viscosity layer, with respect to its neighboring layers, such that the natural frequency response of the interfacial slide flow instability is different from the frequencies of the known process noise sources, and/or the peak amplification is minimized. The present invention also allows one to choose the location of a high or low viscosity layer such that the magnitude of the total wave growth is minimized. Process noise sources have the ability to cause waves at interfaces between layers and these waves may grow or decay depending upon the specific interfacial stability of the system. Process noise sources include hopper vibrations, flow pulsations and particles. Regardless of the type of the disturbance, wave growth of a given frequency (in the flow direction) is the same. The frequency and amplitude of the process noise is easily measured by known methods. Differing disturbances may excite different frequency waves (i.e. hopper vibration, flow pulsation, particles). The method for choosing the placement of a low viscosity layer, i.e. the layer containing hardener, is based on frequency response predictions for interfacial slide flow stability. These are generated by using an experimentally verified theoretical model.

Figure 1:
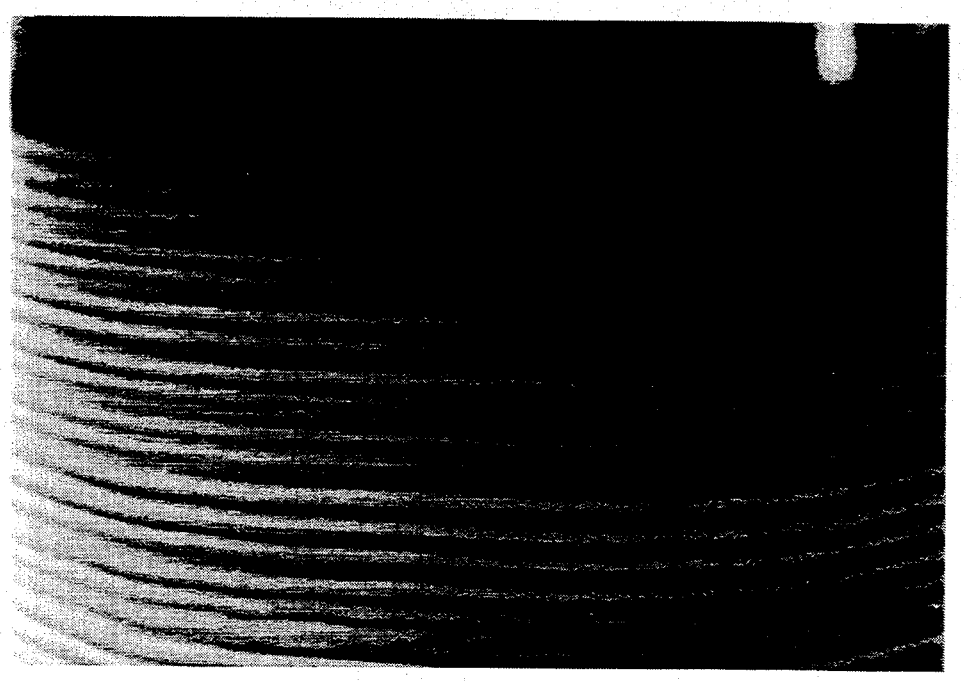
FIG. 1 shows a top view of waves on a hopper slide.
Figure 2:
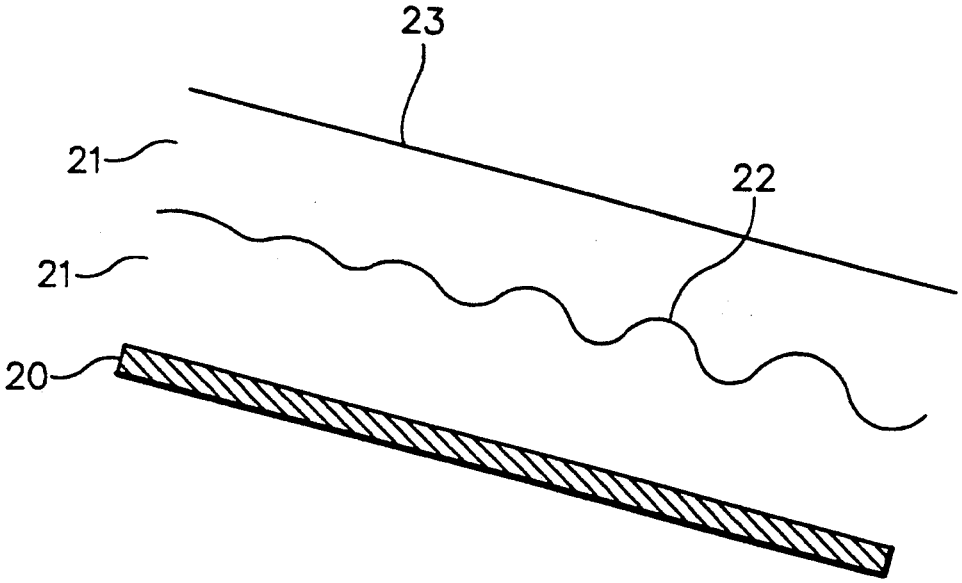
FIG. 2 shows a sectional view of wave growth on a hopper slide.
Figure 3:
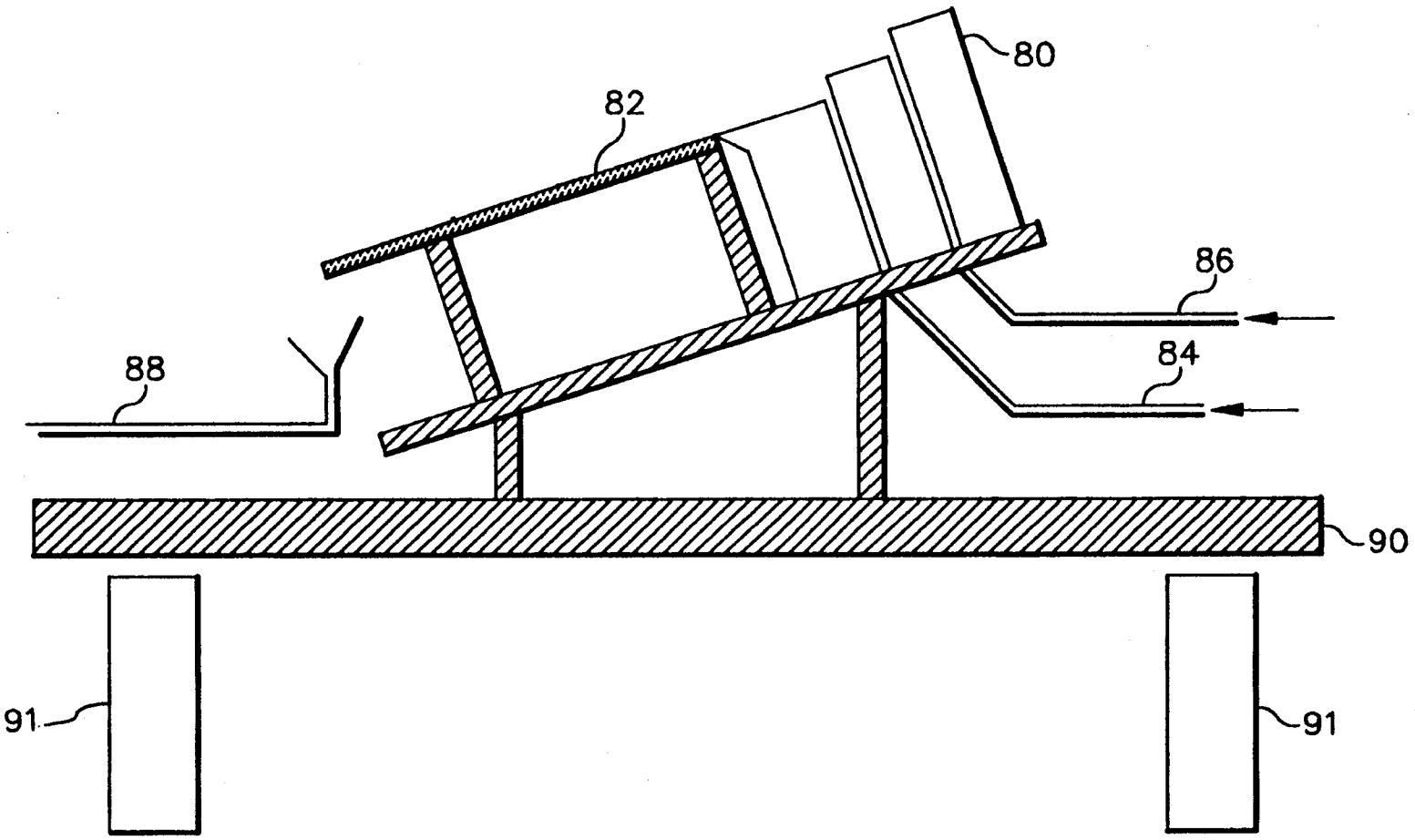
FIG. 3 shows the experimental set up of the extended slide.

An example of interfacial waves is presented in FIGS. 1 and 2. These figures show the consequences of wave growth on the hopper slide. FIG. 1 is an actual image magnified approximately 2X of an interfacial wave on an inclined plane viewed from above. The waves in FIG. 1 are caused by ambient noise, presumably a hopper vibration. There is black carbon in the bottom layer to give optical density to the photograph allowing waves along the fluid-fluid interface 22 (FIG. 2) to be observed. Total volumetric flow was 1.0 cc/cm-sec. The lower layer had a viscosity of 33.3 cp and the top layer had a viscosity of 3 cp. 40% of the total flow was in the bottom layer. FIG. 3 shows the experimental set-up used to obtain the slide wave photographs. The slide hopper 80 included an extended glass plate 82. Photographs of the waves formed on the slide were taken by placing a camera perpendicular to the glass plate and placing light under the plate. Bottom layer flow was supplied through line 84 and top layer flow was supplied through line 86. A catch pan 88 collected the effluent off the slide. The hopper 80 was supported by air table 90 and air supports 91.

FIG. 2 is a schematic of how the interface is distorted as viewed from the side. As seen in FIG. 2, the hopper slide 20 supports the multiple layers 21 as they flow dowel the hopper slide. In FIG. 2 only two layers are supported by the hopper slide 20. Between the two layers 21 is an interface 22. This interface 22 is distorted by the growing waves, where the severity of the distortion is dependent upon the amplitude of the disturbance and the frequency of the disturbance. Note that the air-fluid interface 23, also called the free surface, is also distorted via disturbances, however such distortion is typically controllable via surfactant addition in photographic manufacturing applications. Thus interfacial waves arising between fluid-fluid interfaces (interlayer waves) are of primary concern.

The present method is applicable to many types of multilayer coating including bead coating and curtain coating. It is the viscosity and density differences across the layer interfaces of the layer structure which drive the interfacial instability and cause wave amplification. The prediction of wave amplification is described below.

The first step is to generate growth factor predictions as a function of frequency, over a specified frequency range, on each slide element of the multiple layer slide hopper. The number of growth factor solutions is equal to the number of distinct fluid layers on a slide element provided there is a jump in physical properties across the interface. The growth factor is predicted by an experimentally verified theoretical model incorporated by reference herein, (AICHE Journal, December 1990, Vol. 36, No. 12, *Wave Propagation in the Flow of Shear Thinning Fluids Down an Incline*, S. J. Weinstein) in which a system of linearized partial differential equations are solved numerically resulting in growth factor solutions for each slide element. The growth factor is a measure of interface stability in the units of 1/length. The growth factor is related to wave amplification by the following formula:

$$G(\omega)=e^{\alpha(\omega)L} \quad 1$$

where $\omega$ is the frequency, $G(\omega)$ is the wave amplification as a function of frequency, $\alpha(\omega)$ is the growth factor as a function of frequency and L is the slide length over which growth occurs. Growth factor predictions must be made on each slide element since an additional interface,is added as the fluids flow over each successive hopper metering slot. A specific growth factor is valid at only one frequency, therefore a growth factor versus frequency spectrum must be calculated on each slide element.

Figure 4:
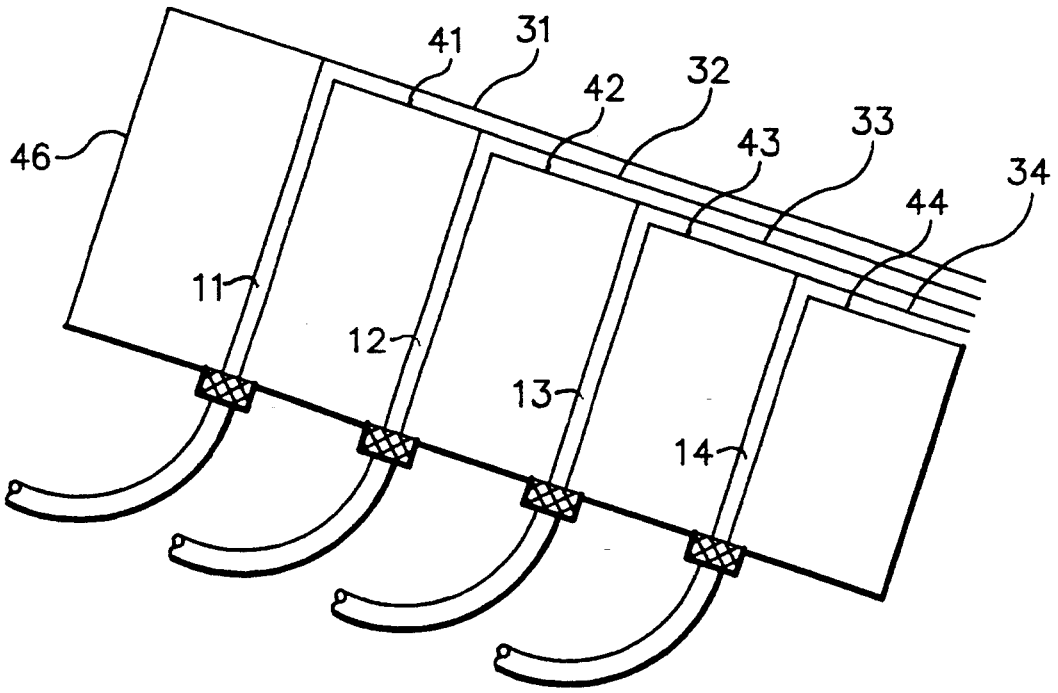
FIG. 4 shows a sectional view of a slide hopper having four layers.

FIG. 4 shows a slide hopper having four metering slots 11, 12, 13 and 14 and therefore four layers in the coating pack. Because the flow configuration changes on each successive slide element (41, 42, 43, 44) and nonuniformities generated on one slide element are transmitted to the next slide element, it is necessary to determine the interfacial wave growth occurring on each slide element and compile these results at the end of the hopper slide.

After growth factor predictions are made for flow on each slide element they are compiled into a total wave amplification spectrum for each interface 31, 32, 33 and 34 which accounts for differing wave growth on each slide element. For a multiple layer configuration on a general slide element there are a number of wave solutions (growth factor versus frequency spectrums). The number of wave solutions is equal to the number of interfaces in the multiple layer system. An interface is defined as any jump in bulk properties (viscosity and/or density) or the interface between fluids which exhibit interfacial tension (surface tension). Each of the wave solutions affects each of the interfaces to some extent. The extent to which any interface is affected by a wave solution is determined by an amplitude function versus frequency for each wave solution at each interface. This function, $a_{ij}(\omega)$, is an amplitude ratio, from 0 to 1, wherein i denotes a wave solution and j denotes an interface as defined previously. $a_{ij}(\omega)$ is calculated simultaneously with the growth factor and is output from theory. The following equation demonstrates the process of compiling growth factor data from the individual slide elements for a specific interface, j. Again, using the previous definition of an interface, the number of interfaces is equal to the number of wave solutions.

$$G_{Tj}(\omega) = \prod_{k=1}^{n} \max_{i}[a_{ij}(\omega)e^{\alpha_i(\omega)L_k}]_k, \quad (2)$$

$i = 1, 2, 3 \ldots$ number of solutions

In Equation 2, $\omega$ is the frequency, k denotes the slide element, n is the total number of slide elements, j denotes a specific interface, i denotes a specific wave solution and is stepped from 1 to the number of wave solutions, $a_{ij}(\omega)$ is an amplitude ratio versus frequency for interface j and wave solution i, $a_i(\omega)$ is the growth factor versus frequency prediction for wave solution i, $$i, \prod_{k=1}^{n}$$

is the product over n slide elements, $L_k$ is the slide length for slide element k, and $G_{Tj}(\omega)$ is the total wave growth for interface j at frequency $\omega$. Therefore, $G_{Tj}(\omega)$ is the product of the maximum amplification on each slide element, due to any of the wave solutions, as determined by the quantity within the brackets in Equation 2. Equation 2, again, shows why theoretical prediction must be made for flow on all slide elements The final result is a total wave amplification versus frequency spectrum for a specific interface in the multilayer structure. This process is repeated for each of the plurality of interfaces in the multilayer structure The last step of the process is to determine the interface with the maximum potential wave amplification and use this as the measure of stability for the multilayer system. Of course, if one layer of the multilayer configuration is much more important to the product quality than the others the stability of one of the interfaces of this layer may be used as the measure of system interfacial stability. However, it is the most conservative position that is being taken here, namely using the interface with the highest amplification as the gauge of interfacial wave growth in the system.

A series of figures demonstrates the utility of judiciously choosing layer placement of a high or low viscosity layer based on predictions of wave amplification versus frequency spectra for a three layer coating pack. For photographic applications of the present invention, typically viscosity differences are of concern and it is assumed that the density of each layer is equal. Although, such examples are given, the present invention is valid for density differences as well.

To illustrate this process a three layer system is studied, first with a low viscosity middle layer and then with a low viscosity bottom layer. The interfacial wave growth results from the interface exhibiting the highest amplification will be compared and layer placement decisions made based on these interfacial stability results. Table 1 shows the viscosity and flow rates of each of the layers used in this example. The hopper configuration used is that shown in FIG. 4. The middle layer is delivered to slots 12 and 13, the top layer is delivered to slot 11 and the bottom layer is delivered to slot 14. This flow configuration will be used to illustrate the utility of Equation 2. In each of the examples all slide element lengths are assumed to be 4.1 cm. For the case of the low viscosity middle layer, i.e. the layer containing hardener, a detailed description of how to use Equation 2 is also included.

TABLE 1

| Layer | Flow Rate (cc/(cm-sec)) | Viscosity (centipoises) | Slots Delivered to |
|---|---|---|---|
| Top | 0.2 | 40 | 11 |
| Middle | 0.7 | 4, 8 | 12 + 13 |
| Bottom | 0.9 | 40 | 14 |

The process of using Equation 2 will now be illustrated. Suppose we are interested in the total wave growth at interface 34 for the case of a 4 centipoise middle layer. Therefore in Equation 2, j is set to 3 to denote interface 34 (Note: in order to solve the equations for interface 34, it is the flow on slide 44 which is of interest). i is stepped from 1 to 3 to evaluate wave solutions 1, 2 and 3. k is set to 4 to denote the flow on the fourth slide element (44). (Note: There is no physical interface 33 since no jump in fluid properties occur.) Thus, there are only three physical interfaces and only three wave solutions. For this case of flow on the fourth slide element (44) the values of $a_{ij}$ and $\alpha_i$ are given below for each wave solution at a frequency of 100 Hz.

| | | | |
|---|---|---|---|
| $a_{11} = 1.0$ | $a_{12} = .854$ | $a_{13} = .256$ | |
| $a_{21} = 0.002$ | $a_{22} = 1.0$ | $a_{23} = 0.02$ | at 100 Hz |
| $a_{31} = 0.003$ | $a_{32} = 0.007$ | $a_{33} = 1.0$ | |
| $\alpha_1 = -1.1$ | $\alpha_2 = 2.2 \times 10^{-13}$ | $\alpha_3 = 1.25$ | at 100 Hz |

Applying equation 2 to the above results in the following total wave amplifications at 100 Hz for interface 3 on slide 4.

$$G_{T3}(100\text{ Hz}) = \prod_{k=4}^{n} \max[a_{13}e^{\alpha_1 L_4}, a_{23}e^{\alpha_2 L_4}, a_{33}e^{\alpha_3 L_4}] \quad (3)$$

-continued $$G_{T3}(100\text{ Hz}) = \max[0.256\cdot^{(-1.1)(4.1)},\ 0.02e^{(2.2\times10-13)(4.1)},\ 10\cdot^{(1.25)4.1}]$$

$$G_{T3}(100\text{ Hz}) = \max[0.003,\ 0.02,\ 163]$$

Therefore $G_{T3}(100\text{ Hz}) = 163$

Figure 5:
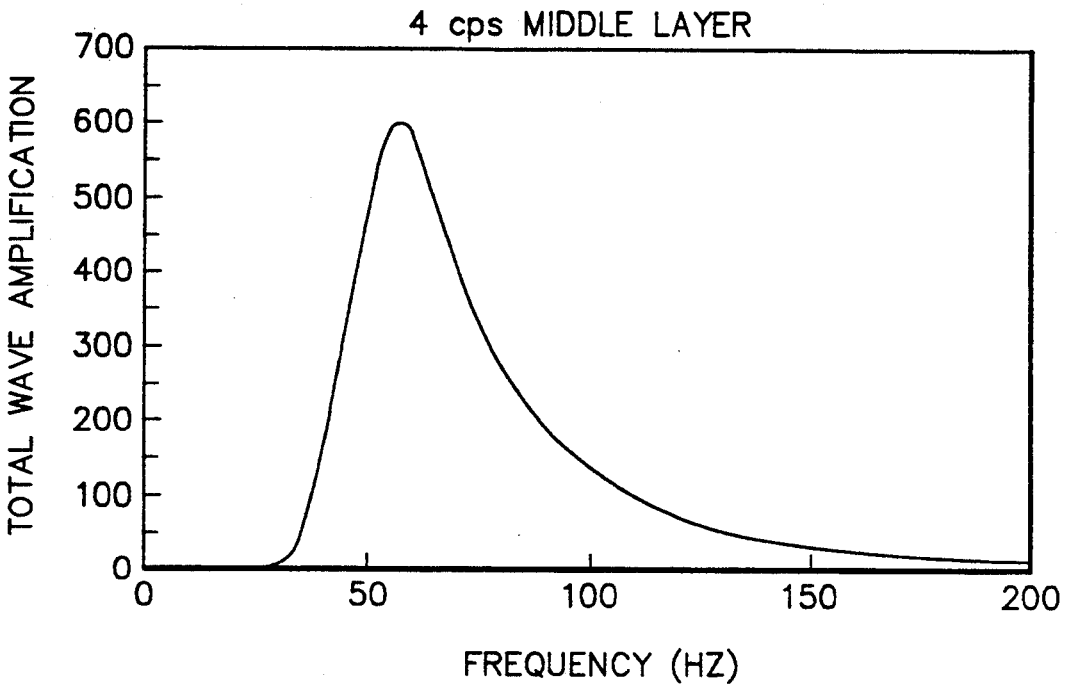
FIG. 5 shows the total wave amplification versus frequency for a four layer system on a hopper slide wherein the middle layer has a viscosity of 4 centipoise.
Figure 6:
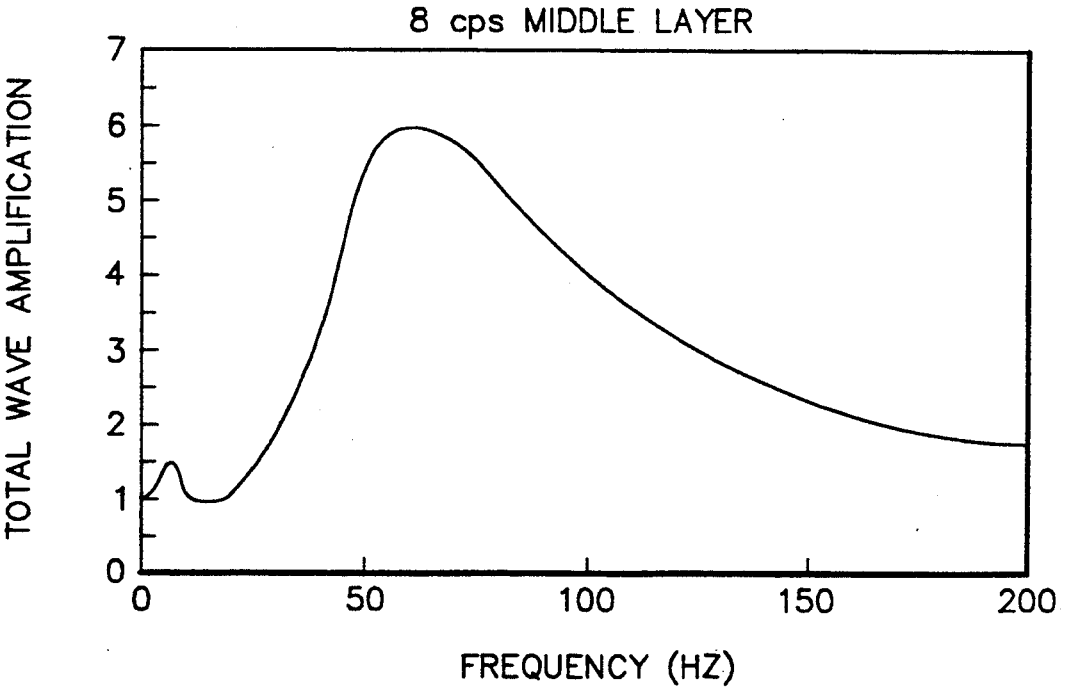
FIG. 6 shows total wave amplification versus frequency for a four layer system on a hopper slide wherein the middle layer has a viscosity of 8 centipoise.

FIGS. 5 and 6 show the result of the maximum amplified interface for both the 4 and 8 centipoise middle layer cases. In each case it is interface 34 on FIG. 4 which is most amplified.

Table 2 shows the viscosity and flow rate of each of the layers used to make the predictions where the low viscosity layer placement i.e., the layer containing hardener, is at the bottom of the multilayer coating structure. The hopper configuration used is shown in FIG. 4. The top layer is delivered to slot 11, the middle layer is delivered to slot 12 and the bottom layer is delivered to slot 13 and 14.

TABLE 2

| Layer | Flow Rate (cm/cm*sec) | Viscosity (centipoises) | Slots Delivered to |
|---|---|---|---|
| Top | 0.2 | 40 | 11 |
| Middle | 0.7 | 40 | 12 |
| Bottom | 0.9 | 4, 8 | 13 + 14 |

Figure 7:
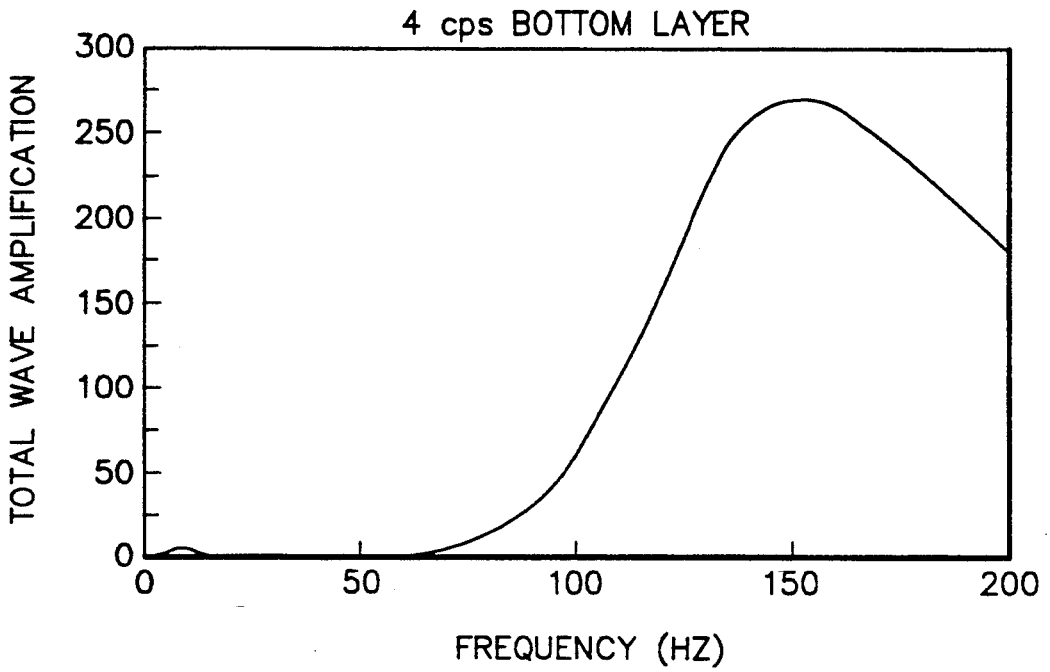
FIG. 7 shows total wave amplification versus frequency for a four layer system on a hopper slide wherein the bottom layer has a viscosity of 4 centipoise.
Figure 8:
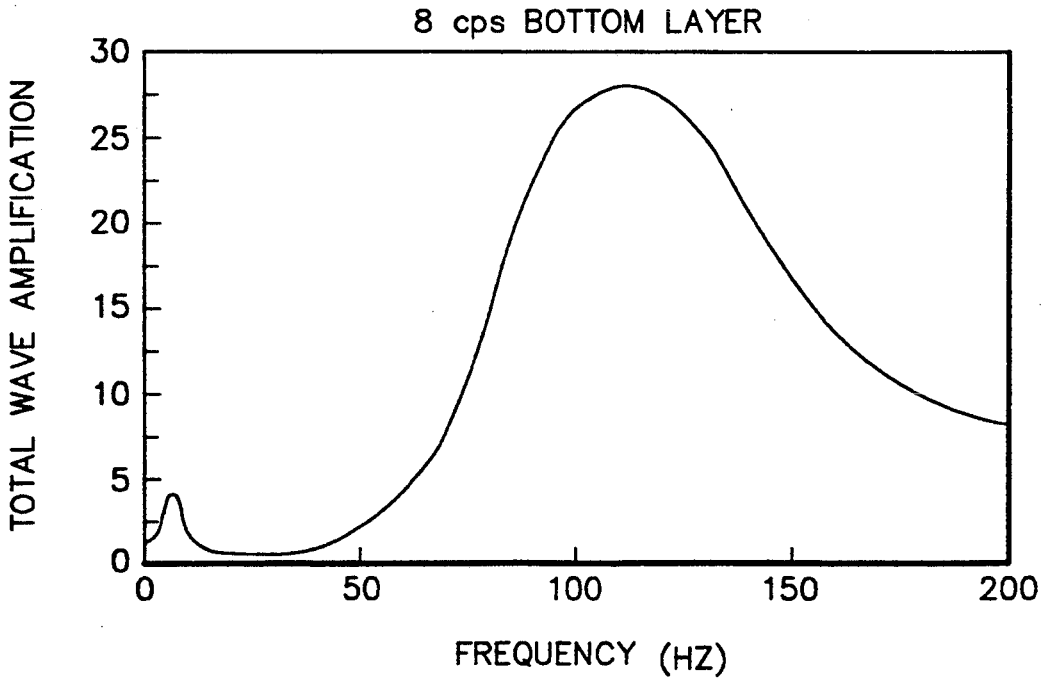
FIG. 8 shows total wave amplification versus frequency for a four layer system on a hopper slide wherein the bottom layer has a viscosity of 8 centipoise.

FIGS. 7 and 8 show the results of the most amplified interface for both the 4 and 8 centipoise bottom layer cases. In each case it is interface 33 which is most amplified.

FIGS. 5 through 8 illustrate the potential of applying this technique for prediction of multiple layer interfacial stability. Changing the low viscosity layer placement from the middle position to the bottom position has two dramatic effects. First, placement of the low viscosity fluid in the bottom position results in a large amplification region shifted to a much higher frequency when compared to placement of the low viscosity fluid in the middle position. Peak amplification was at 75 Hz for the 4 centipoise middle layer and 150 Hz for the 4 centipoise bottom layer. Second, peak amplification can be lower in either the bottom layer placement or the middle layer placement depending on which viscosity is used when the comparison is made (e.g. 4 centipoise middle layer with 4 centipoise bottom layer or 8 centipoise middle layer with 8 centipoise bottom layer).

Suppose now that the machine that will coat the multiple layer structure detailed in Tables 1 and 2 has a natural perturbation at 50 Hz. For the 8 centipoise middle layer case the amplification of the interfacial wave created by this vibration will be 2.5 times and for the 8 centipoise bottom layer case will be 1.5 times. Now suppose the vibration is at 100 Hz, for the 8 centipoise middle layer case the amplification of the interfacial layer created will be 4.25 times and for the 8 centipoise bottom layer case will be 27 times. Depending upon the actual frequency of the perturbation either placement may be advantageous.

Knowing the frequencies and amplitudes of the natural perturbations of the coating machine coupled with interfacial wave amplification information gives the coating engineer the ability to wisely choose the location of the low viscosity layer, i.e. the layer containing hardener, so as to minimize interfacial nonuniformity due from a number of perturbation sources.

The procedure described above allows for the choosing of the position of a layer containing hardener so as to minimize wave amplification. The present invention also allows the determination of whether interfacial wave growth in the chosen position is adequate to meet the manufacturing standards for a photographic application. In this procedure it is wave amplitudes which are calculated such that the amplitude of the final wave determines the degree of nonuniformity in the layer. The final interfacial wave amplitude, $A_f$, is related to the total wave amplification (henceforth referred to as total gain) and initial amplitude, $A_i$ as:

$$A_f = A_i \times (\text{total gain}) \tag{4}$$

As Equation 4 shows, waves must exist before they can begin to grow. The initial amplitudes of these waves are directly related to the effectiveness of the given disturbance in transferring its energy to the wave. It has been shown that hopper vibrations and melt inhomogeneities are quite efficient sources of waves, and are perhaps the most common and troublesome perturbation sources seen in practice. For a given magnitude disturbance to the slide flow, the bottom line issue is to determine the magnitude of the coating nonuniformity which will be seen on the web. A given maximum tolerable thickness variation in a coated product can thus be translated into machine specifications on allowable hopper vibrations, delivery pulsations, and even the size of the impurities in the melts. Experiments have focused on the initial amplitudes associated with hopper vibrations and melt inhomogeneities.

For hopper vibrations, experiments have shown that the initial wave amplitude, $A_i$, in Equation 4, is nearly equal to the amplitude of the vibration, denoted by $A_v$. The vibration amplitude $A_v$ is the amplitude of the process noise at a specified frequency. Coatings imperfections on the web are perceived by the eye as thickness variations. Thus, the degree of coating nonuniformity on the web can be quantified by dividing the final amplitude on the slide using Equation 4 by the thickness of the layer whose nonuniformity is to be assessed on the slide element closest to the web. The result is:

$$\text{Percent Thickness Variation} = \frac{2 \times A_v \times (\text{Total Gain})}{\text{Layer Thickness On Slide}} \times 100\% \tag{5}$$

In Equation 5, a factor of 2 has been included in the numerator to account for the fact that the transition from shear flow on the slide to plug flow on the web causes a change in layer thickness which effectively yields a wave amplification at each interface of a factor of 2. Now, suppose that the maximum tolerable thickness variation in a web coating is approximately 0.5%. This allowable thickness variation will be dependent upon the layer properties including the emulsion layer, the interlayer, the dye containing layer, etc. The 0.5% variation is generally used as a generic layer uniformity limit. Thus, by using Equation 5 with this 0.5% value, a determination of whether a coating event will yield acceptable product is possible. Equivalently, for a given vibration amplitude it is possible to rewrite Equation 5 as a criterion for the total gain on the slide as:

$$\frac{\text{Total Gain}}{\text{Layer Thickness On Slide}} \leq \frac{0.0025}{A_v} \tag{6}$$

In Equation 6, the total gain has been divided by a layer thickness on the slide element closest to the web, since for a given initial amplitude, a thinner layer can tolerate less wave growth than a thicker one. Thus it makes sense to define a quantity called the normalized gain as:

$$\text{Normalized Gain} = \frac{\text{Total Gain}}{\text{Layer Thickness On Slide}} \quad (7)$$

Again, the particular thickness to use in Equation 7 depends upon the layer thickness whose uniformity is to be assessed. The gain criteria and results are now reported as normalized gains. As previously discussed, the choice of flow conditions affects the total gain; choosing flow conditions wisely, such as by increasing the flow percentage of the bottom layer or generally decreasing the viscosity jumps across layers may diminish wave growth enough so that Equation 6 is satisfied.

Figure 9B:
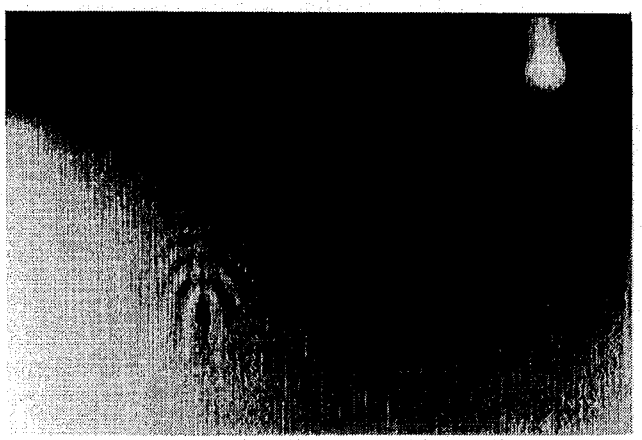
FIGS. 9 (*a*) and 9 (*b*) show a photograph of motorboats on a hopper.
Figure 9A:
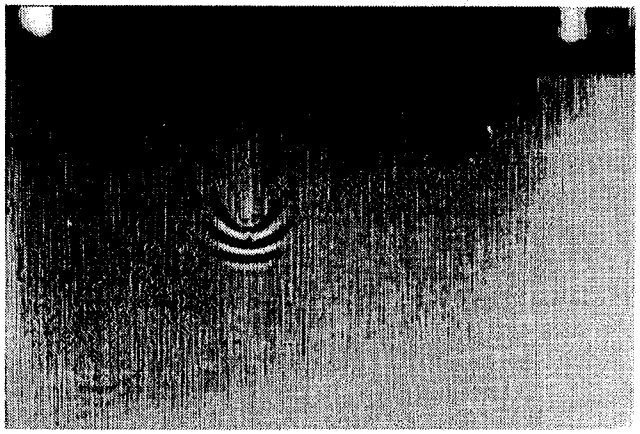
Figure 10B:
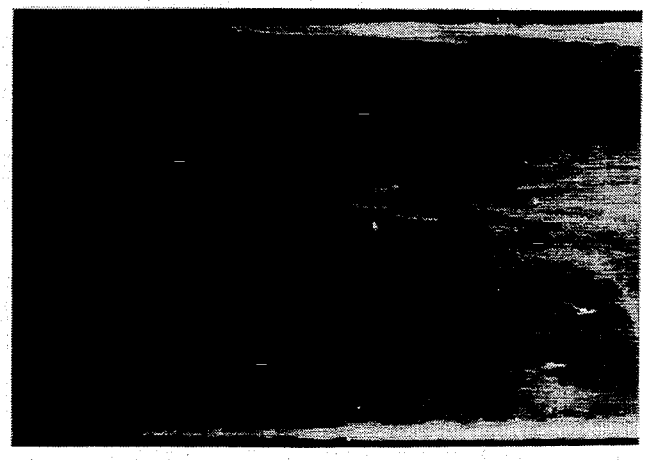
FIGS. 10 (*a*) and 10 (*b*) show a photograph of motorboats after being coated onto a web and dried.
Figure 10A:
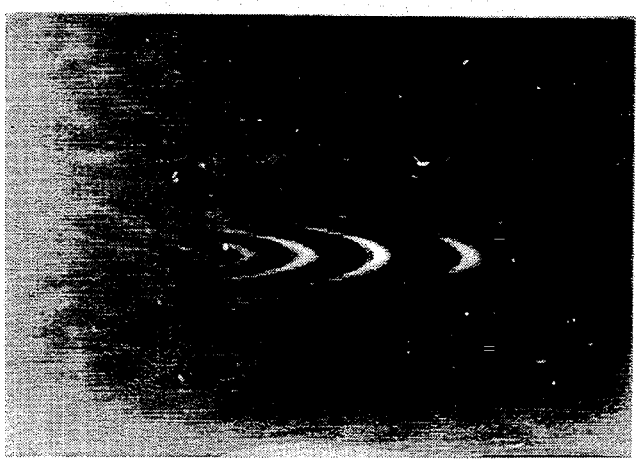

Melt inhomogeneities such as particles, gel slugs and bubbles often give rise to localized wave formation which we call motorboats. FIGS. 9 (*a*) and (*b*) show photographs of motorboats on the extended slide apparatus of FIG. 3. In FIG. 9 (*a*), the top layer had a viscosity of 33.8 and the bottom layer had a viscosity of 3 cp. The bottom layer represented 20% of the total flow of 1 cc/cm-sec. In FIG. 9 (*b*), the top layer had a viscosity of 3 cp and the bottom layer had a viscosity of 33.8 cp. The bottom layer represented 40% of the total flow of 1 cc/cm-sec. The motorboat orientation changes when the viscosities of the layers are flipped. FIGS. 10 (*a*) and (*b*) represent the dried web samples of coating runs using the conditions outlined in FIGS. 9 (a) and (*b*), respectively. The occurrence of motorboats often precedes the onset of full-scale slide cross streaks caused by hopper vibrations, flow pulsations and the like. Since wave growth i.e, the growth factor in Equation 1, depends on the particular coating conditions and not on the type of initiating disturbance, this indicates that the initial wave amplitudes induced by the particles are typically larger than those induced by room noise such as hopper vibrations and flow pulsations. Consequently, the onset of motorboats often provides a practical bound on the stability of a given system, since avoiding motorboats makes it likely that slide cross-streaks will be avoided.

The effect of particle size on the waves which form has been investigated by introducing well characterized particle sizes into extremely clean two layer aqueous gelatin systems. It has been found that as the particle size increases, the critical wave growth above which motorboats can be observed decreases. Thus, large particle size leads to large initial wave amplitudes, and it takes less wave growth for motorboats to be observed. Furthermore, our results indicate that melt inhomogeneities can induce full-scale mottle, i.e., full width nonuniformity, which appears to be the super position of many motorboats which extends full width across the coating. This slide mottle appearance is quite similar to the appearance of slide waves found in production and pilot coatings where room noise excite waves. Consequently, the results imply that melt inhomogeneities, such as silver grains themselves, may be an important component of noise leading to slide waves.

From these experiments the normalized gain (from Equation 7) below which motorboats and particle induced slide mottle could be avoided was estimated as a function of particle size. Table 3 shows results for a two layer coating pack having a lower bottom layer viscosity than that of the top layer.

| Particle Size, cm $\times 10^{-4}$ | Normalized Gain, $cm^{-1}$ |
|---|---|
| 8 | 2800 |
| 23 | 2100 |
| 50 | 290 |
| 110 | 70 |

In manufacturing the largest particle sized diameter of concern, with all systems performing within process control limits, is about $25\times_{-4}$ cms. Therefore a maximum normalized gain from Equation 8 of 2100 is applied when investigating the susceptibility of a product to particle induced waves.

Figure 11:
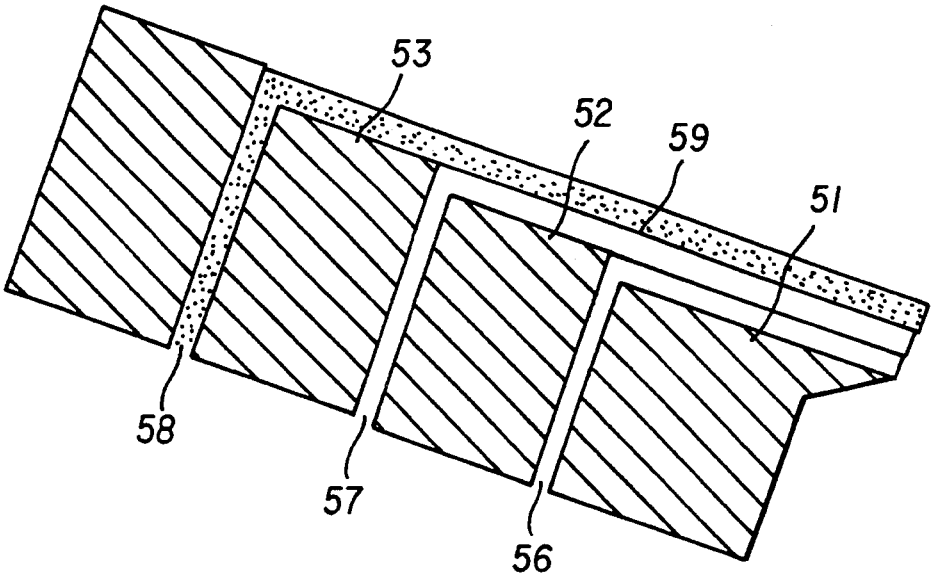
FIG. 11 shows the setup used to obtain normalized gain results.

The following examples of a two layer system are provided. Shown in FIG. 11 is the setup used for these examples. In this system, each slide element was 2.54 cm long and the lip element was 3.81 cm long. The total flow rate per Unit width in each example was 1.14 $cm^3$/cm-sec. The bottom layer is delivered through slots 56 and 57 in FIG. 11, where the flow is divided equally between the two slots 56, 57. The flow rate and viscosity are varied as described below. To calculate the total gain, Equation 1 was used. The wave growth occurring on slide element 53 is neglected since surface waves are typically damped out by surfactants. Thus the focus is on interlayer wave growth along interface 59 in FIG. 11. There is no change in physical properties between the bottom layers delivered through slots 56 and 57 and there is no physical interface there. The growth factors were determined as previously described and are shown in Table 4 for a bottom layer having a viscosity of 3.04 cp. Although, growth factors are frequency dependent, the largest growth factor at a given coating condition was used to give a measure of wave growth. In calculating the normalized gains in Table 1, we have assumed that the thickness layer variations in both layers on slide element 51 are important. Thus, the smallest thickness was chosen to calculate the normalized gains to yield the most conservative thickness variation estimate.

TABLE 4

| 33.83 cp Top Layer, 3.04 cp Bottom Layer | | | | | |
|---|---|---|---|---|---|
| Bottom Layer Coated Thickness | Growth Factors | | Slide Layer Thickness cm on Lip Element (Slide 51) | | Normalized Gain |
| % of Total | Slides 51 | Slides 52 | Top | Bottom | (1/cm) |
| 20 | 0.8014 | 0.7383 | 0.04747 | 0.02333 | 5923.2 |
| 30 | 0.7463 | 0.7942 | 0.03914 | 0.03122 | 4135.5 |
| 40 | 0.5873 | 0.7904 | 0.03279 | 0.03931 | 2127.8 |
| 50 | 0.4008 | 0.6986 | 0.02748 | 0.04807 | 988.1 |
| 60 | 0.2429 | 0.5319 | 0.02277 | 0.05796 | 427.9 |
| 70 | 0.1325 | 0.3435 | 0.01846 | 0.06963 | 214.7 |

Note that for a given bottom layer coated thickness, the growth factors on slide elements 51 and 52 are not the same. The results also show that as the bottom layer becomes thicker, the normalized gain diminishes. Thus, increasing the bottom layer will enhance coating uniformity.

Table 5 shows the effect of increasing the bottom layer viscosity to 5.55 cp. with all other conditions the same as investigated in Table 4.

TABLE 5

| 33.83 cp Top Layer, 5.55 cp Bottom Layer | | | | | |
|---|---|---|---|---|---|
| Bottom Layer Coated Thickness | Growth Factors | | Slide Layer Thickness cm on Lip Element (Slide 51) | | Normalized Gain |
| % of Total | Slides 51 | Slides 52 | Top | Bottom | (1/cm) |
| 20 | 0.5000 | 0.4106 | 0.05660 | 0.02875 | 663.2 |
| 30 | 0.4638 | 0.4518 | 0.04713 | 0.03831 | 481.4 |
| 40 | 0.4004 | 0.4711 | 0.03971 | 0.04815 | 383.1 |
| 50 | 0.2986 | 0.4482 | 0.03340 | 0.05881 | 291.6 |
| 60 | 0.1939 | 0.3726 | 0.02774 | 0.07088 | 194.4 |

Comparing these results with these shown in Table 4, it is clear,that increasing the bottom layer viscosity reduces the normalized gain levels significantly, especially at smaller bottom layer thicknesses. Thus, for a maximum normalized gain of 2100, coating uniformity is assured in all cases in Table 5 and in cases where the bottom layer thickness is greater than 50% as shown in Table 4.

The advantage of the present invention over the prior art is quantification of the interfacial stability and compilation into a usable form for making educated decisions about layer placement when there are one or more layers in a multiple layer coating pack whose viscosity or density is much higher or lower than the other layers in the pack. It is specifically the compilation of growth factor data into a slide wave amplification versus frequency spectrum for each interface in a multiple layer coating which allows the coating engineer to decide which layer placement option is best for the specific photographic application in which he or she is interested, The present invention deals with this problem more accurately while resulting in much less development time and much less risk of a system with marginal stability being manufactured; thus waste is reduced in manufacturing processes through the use of the current invention.

What is claimed:

1. A method to determine whether a coating event will produce acceptable product on a web fed through a coating station, the coating station including a hopper having a plurality of parallel metering slots between a plurality of hopper elements which form an inclined surface, the plurality of metering slots delivering a plurality of liquid layers which flow down the inclined surface superimposed on one another; the superimposed layers forming a plurality of interfaces between the superimposed layers; comprising:

a) determining a frequency and amplitude of process noise associated with the coating station;

b) determining growth factor and amplitude ratio as a function of frequency for each of the plurality of interfaces over each slide element for a situation wherein a diffusible hardener is added to one of the plurality of layers;

c) converting the plurality of growth factors as a function of frequency obtained in step (b) to a plurality of maximum wave amplifications versus frequency for each of the plurality of interfaces;

d) determining a plurality of wave amplitudes versus frequency by multiplying the amplitude determined in step (a) for each frequency by the plurality of maximum wave amplifications obtained from step (c);

e) determining a layer thickness on a slide element closest to the web for each of the plurality of liquid layers;

f) determining a percentage thickness variation for each layer by multiplying the maximum wave amplitude at each frequency for step (c) by two and dividing by the layer thickness from step (e) and multiplying by 100;

g) determining whether a maximum percentage variation from step (f) is less than a value; and h) coating the product on the web if the maximum percentage variation from step (g) is less than the value.

2. The method according to claim 1 wherein the value is 0.5 percent.

3. A method to determine whether a coating event will produce acceptable product on a web fed through a coating station, the coating station including a hopper having a plurality of parallel metering slots between a plurality of hopper elements which form an inclined surface, the plurality of metering slots delivering a plurality of liquid layers which flow down the inclined surface superimposed on one another; the superimposed layers forming a plurality of interfaces between the superimposed layers; comprising:

a) determining a frequency and amplitude of process noise associated with the coating station;

b) determining growth factor and amplitude ratio as a function of frequency for each of the plurality of interfaces over each slide element;

c) converting the plurality of growth factors as a function of frequency obtained in step (b) to a plurality of maximum wave amplifications versus frequency for each of the plurality of interfaces;

d) determining a plurality of wave amplitudes versus frequency by multiplying the amplitude determined in step (a) for each frequency by the plurality of maximum wave amplifications obtained from step (c);

e) determining a layer thickness on a slide element closest to the web for each of the plurality of liquid layers;

f) determining a percentage thickness variation for each layer by multiplying the maximum wave amplitude at each frequency for step (d) by two and dividing by the layer thickness from step (e) and multiplying by 100;

g) determining whether a maximum percentage variation from step (f) is less than a value; and h) coating the product on the web if the maximum percentage variation from step (g) is less than the value.

4. The method according to claim 3 wherein the value is 0.5 percent.

5. A method to determine whether a coating event will produce acceptable product on a web fed through a coating station, the coating station including a hopper having a plurality of parallel metering slots between a plurality of hopper elements which form an inclined surface, the plurality of metering slots delivering a plurality of liquid layers which flow down the inclined surface superimposed on one another; the superimposed layers forming a plurality of interfaces between the superimposed layers; comprising:

a) determining growth factor and amplitude ratio as a function of frequency for each of the plurality of interfaces over each slide element;

b) converting the plurality of growth factors as a function of frequency obtained in step (a) to a plurality of maximum wave amplifications versus frequency for each of the plurality of interfaces;

c) determining a layer thickness on a slide element closest to the web for each of the plurality of liquid layers;

d) dividing the maximum of the plurality of wave amplifications from step (b) by the layer thickness on the slide to produce a normalized gain for each layer;

e) determining whether the normalized gains are less than a value; and f) coating the product on the web if the normalized gains are less than the value.

6. The method according to claim 5 wherein the value is 2100.

7. A method to determine whether a coating event will produce acceptable product on a web fed through a coating station, the coating station including a hopper having a plurality of parallel metering slots between a plurality of hopper elements which form an inclined surface, the plurality of metering slots delivering a plurality of liquid layers which flow down the inclined surface superimposed on one another; the superimposed layers forming a plurality of interfaces between the superimposed layers; comprising:

a) determining growth factor and amplitude ratio as a function of frequency for each of the plurality of interfaces over each slide element for situation wherein a diffusible hardener is added to one of the plurality of layers;

b) converting the plurality of growth factors as a function of frequency obtained in step (a) to a plurality of maximum wave amplifications versus frequency for each of the plurality of interfaces;

c) determining a layer thickness on each slide element for each of the plurality of liquid layers;

d) dividing the maximum of the plurality of wave amplifications from step (b) by the layer thickness on the slide element closest to the web to produce a normalized gain;

e) determining whether the normalized gain is less than a value; and f) coating the product on the web if the normalized gain is less than the value.

8. The method according to claim 7 wherein the value is 2100.

* * * * *